United States Patent [19]

Takumi

[11] Patent Number: 4,485,851

[45] Date of Patent: Dec. 4, 1984

[54] APPARATUS FOR RAISING HOOKS OF SEMI-FINISHED SPRING PRODUCTS

[75] Inventor: Hiroshi Takumi, Neyagawa, Japan

[73] Assignee: Shinko Machinery Co., Ltd., Neyagawa, Japan

[21] Appl. No.: 515,148

[22] Filed: Jul. 19, 1983

[30] Foreign Application Priority Data

Feb. 22, 1983 [JP] Japan ..... 58-27893

[51] Int. Cl.[3] ..... B21F 35/02

[52] U.S. Cl. ..... 140/103; 72/137

[58] Field of Search ..... 72/133, 137; 140/103

[56] References Cited

U.S. PATENT DOCUMENTS

| | | | |
|---|---|---|---|
| 2,584,836 | 2/1952 | Blumensaadt | 140/103 |
| 3,192,748 | 7/1965 | Lange | 140/103 |
| 3,230,985 | 1/1966 | Kaufman | 140/103 |
| 4,236,397 | 12/1980 | Lange | 72/137 |

FOREIGN PATENT DOCUMENTS

| | | |
|---|---|---|
| 50-7548 | 3/1975 | Japan . |
| 52-5021 | 2/1977 | Japan . |
| 52-42128 | 9/1977 | Japan . |

*Primary Examiner*—E. Michael Combs
*Assistant Examiner*—Charles Rosenberg
*Attorney, Agent, or Firm*—Armstrong, Nikaido, Marmelstein & Kubovcik

[57] ABSTRACT

The present invention relates to an apparatus for raising hooks of semi-finished springs, which includes a rocking arm arranged to be pivotally movable between an upper and a lower positions and having a pair of lateral semi-finished spring holding pieces at its forward end portion for transferring the semi-finished springs manufactured by a spring manufacturing machine towards a hook raising section provided above a spring discharge opening formed in a table of the apparatus, a clamping unit for fixedly clamping the semi-finished spring holding pieces which have been transferred to the hook raising section, a rotational position control member which rotates the semi-finished spring held between the semi-finished spring holding pieces for its positional control, and a pair of slide members on which hook raising tools are mounted and which are adapted to freely advance towards or retracted from the hook raising section. The apparatus is capable of automatically discharging the finished springs through the discharge opening by opening the pair of lateral holding pieces after accurately effecting the hook raising of the semi-finished spring above the spring discharge opening of the table through the positional control of the semi-finished springs.

6 Claims, 5 Drawing Figures

APPARATUS FOR RAISING HOOKS OF SEMI-FINISHED SPRING PRODUCTS

BACKGROUND OF THE INVENTION

The present invention generally relates to a hook raising apparatus and more particularly, to an apparatus for raising hooks of semi-finished spring products which are produced by a spring manufacturing machine.

Conventionally, there have been various disadvantages as follows in the apparatuses of the above described type.

In the first place, since the known apparatus as referred to above is so arranged that semi-finished springs processed by a spring manufacturing machine are each transferred to a hook raising section by subjecting a horizontal rocking arm having a pair of vertically arranged upper and lower semi-finished spring holding pieces, to a rocking or pivotal movement in a horizontal direction, it has been extremely difficult to correctly discharge the springs completed for raising hooks and held between the holding pieces, only by the mere opening or spacing between the pair of upper and lower holding pieces, and therefore, in order to automatically discharge the processed springs from between said pair of upper and lower holding pieces, a spring discharge unit is required to be separately installed for the purpose. In the second place, in the conventional apparatus as described above, owing to the fact that no mechanism is provided for controlling position of the semi-finished spring held between the pair of upper and lower holding pieces, there have been cases where the semi-finished spring is not correctly positioned as preliminarily set with respect to hook raising tools, thus resulting in an increased rate of faulty items produced. In the third place, since the prior art apparatuses are generally arranged to effect the raising of hooks merely by holding the semi-finished springs between the pair of upper and lower holding pieces, there has been such an inconvenience that the pair of upper and lower holding pieces are undesirably spaced by yielding to a force which may be exerted on the semi-finished spring during the processing thereof.

SUMMARY OF THE INVENTION

Accordingly, it is a primary object of the present invention to provide an improved hook raising apparatus which is capable of automatically discharging finished springs without necessity for installing any particular unit for the purpose, and which is also able to effect the hook raising after proper positional control of the semi-finished springs so as to substantially eliminate disadvantages inherent in the conventional apparatuses of this kind.

It is another object of the present invention to provide a hook raising apparatus of the above described type which is so arranged that the semi-finished springs to be processed for raising of hooks are each held laterally at their side portions instead of being held vertically as in the conventional apparatus, for automatic discharge of the finished springs in an efficient manner.

For accomplishing these and other objects, a hook raising apparatus according to one preferred embodiment of the present invention includes a rocking arm arranged to be pivotally movable vertically, i.e. between upper and lower positions and having a pair of lateral or left and right semi-finished spring holding pieces at its forward end for transferring the semi-finished springs produced by a spring manufacturing machine towards a hook raising section located above a spring discharge opening formed in a table of the apparatus, a clamping unit for fixedly clamping the semi-finished spring holding pieces which are transferred to said hook raising section, a rotational position control member which rotates the semi-finished spring held between the semi-finished spring holding pieces for positional control thereof, and a pair of slide members on which hook raising tools are mounted and which are adapted to selectively advance towards or retracted from the hook raising section as desired.

It is to be particularly noted that, according to the arrangement of the present invention, since the pair of left and right semi-finished spring holding pieces for holding the semi-finished spring at the side portions thereof are provided on the rocking arm pivotable between lower and upper positions, the spring processed for the hook raising in a position above the discharge opening formed in the table for the apparatus spontaneously falls downwardly upon opening or spacing between the pair of holding pieces for automatic discharge through the discharge opening. Moreover, since the positional control of the semi-finished spring can be effected by the rotational position control member, the number of faulty items involved may be extremely reduced. Furthermore, owing to the arrangment that the semi-finished spring holding pieces are fixedly held by the clamping unit, there is no possibility that the semi-finished spring holding pieces are undesirably spaced or opened during the hook raising processing.

DETAILED DESCRIPTION OF A EMBODIMENT ACCORDING TO THE PRESENT INVENTION

Figure 2:
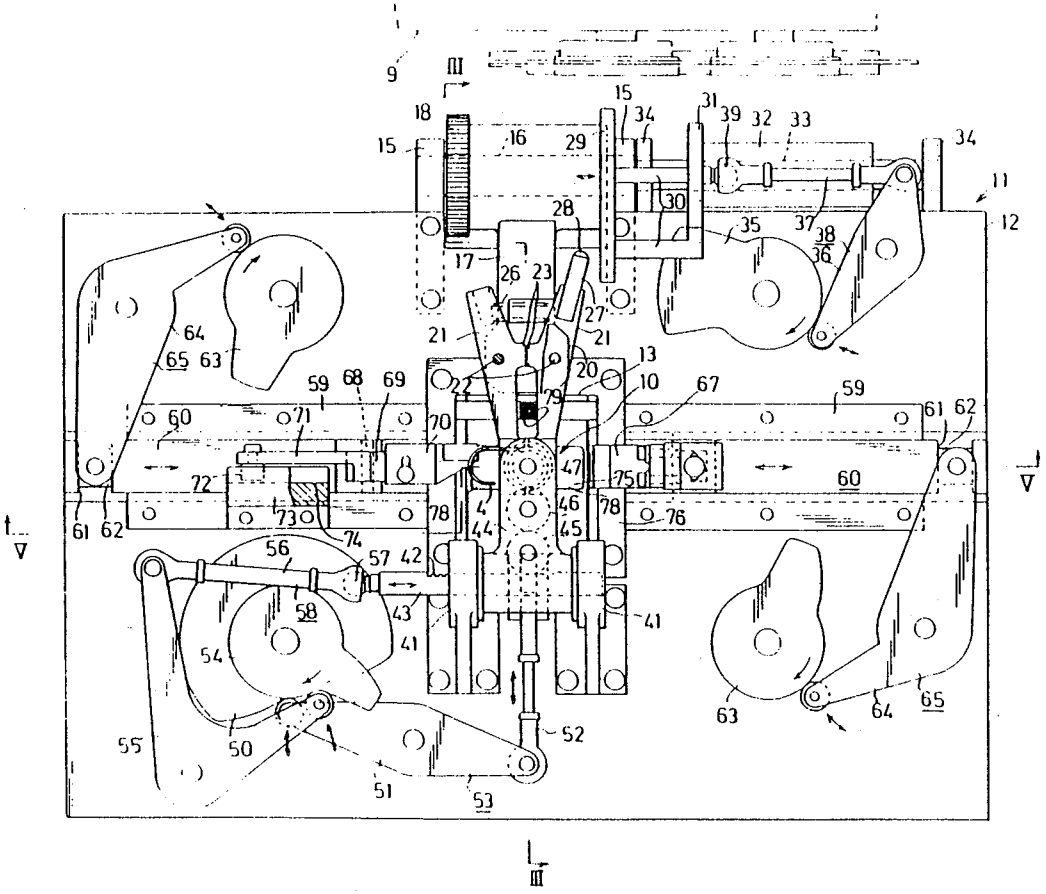
FIG. 2 is a top plan view, partly broken away, of a hook raising apparatus for semi-finished springs according to one preferred embodiment of the present invention.

Referring now to the drawings, the present invention will be described in detail hereinbelow.

Figure 1:
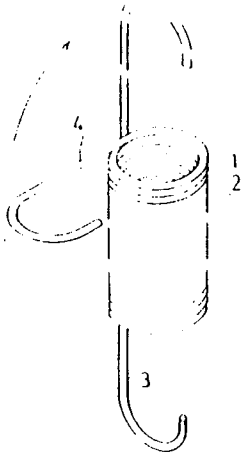
FIG. 1 is a perspective view of a semi-finished spring product to be processed by an apparatus of the present invention.

In FIG. 1, there is shown a perspective view of a semi-finished spring product 1 (referred to merely as a semi-finished spring 1 hereinbelow), which has a main body 2, a lower hook 3 formed at the lower portion of the main body 2 and completed for raising, and an upper hook 4 formed at the upper of said main body 2 and not subjected to the hook raising processing as yet. It is to be noted that the hook raising apparatus 11 according to the present invention to be described hereinbelow, is intended to raise the upper hook 4 of the semi-finished spring 1 as described above, and that such semi-finished spring 1 is manufactured by a known spring manufacturing machine 9 partly shown by chain lines in FIG. 2. It should further be noted that FIG. 1 shows only one example of the semi-finished spring 1, and the configurations of the hooks 3 and 4 may be altered in various ways as desired.

Referring particularly to FIGS. 2 to 5, there is shown the apparatus 11 for raising the hook 4 of the semi-finished spring 1 according to one preferred embodiment of the present invention.

The hook raising apparatus 11 as illustrated includes a table 12 arranged to be movable in a vertical direction, and also, in lateral or leftward and rightward directions ("leftward direction" means "direction towards the left side" and "rightward direction" means "direction towards the left side" in FIG. 2) with respect to a base (not shown) for positional adjustment to the spring manufacturing machine 9 so as to be fixed at desired positions in relation to the base.

Figures 3, 4:
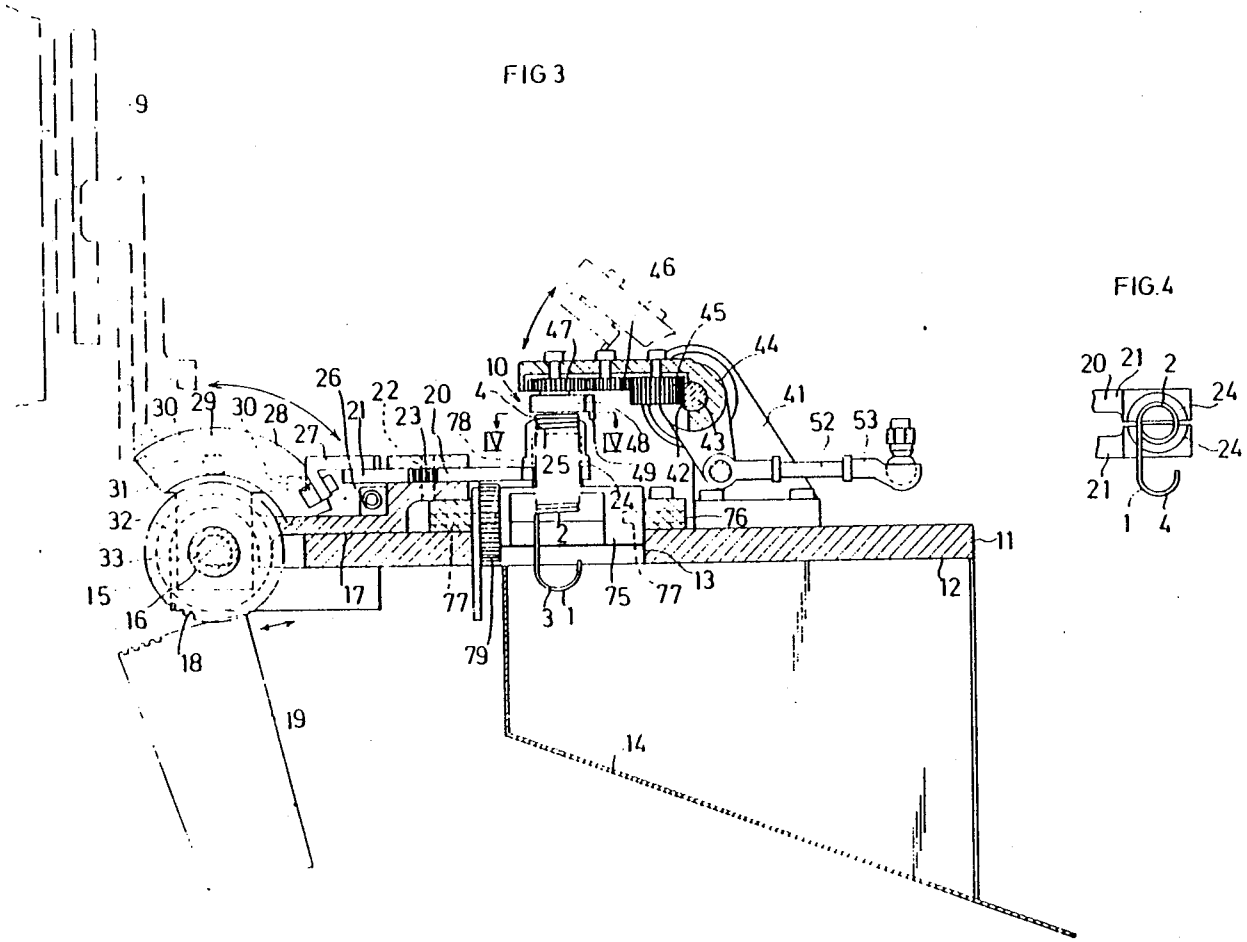
FIG. 3 is a cross sectional view taken along the line III—III in FIG. 2.
FIG. 4 is a fragmentary cross sectional view taken along the line IV—IV in FIG. 3.

As clearly shown in FIGS. 2 and 3, at generally a central portion of the table 12, there is formed a rectangular discharge opening 13 for discharging finished springs therethrough, below which opening 13, a chute 14 for leading the discharged springs towards the front portion ("front" means the "right side", and "rear" means the "left side" in FIG. 3) of the apparatus 11 for discharging. Above the spring discharge opening 13 as described above, there is provided a hook raising section (or space) 10 to be described more in detail later.

A shaft 16 is supported by a pair of bearings 15 mounted at the rear portion of the table 12, while, on said shaft 16, a rocking arm 17 is pivotally mounted for transferring the semi-finished spring 1 produced by the spring manufacturing machine 9 to the hook raising section (or space) 10 formed above the spring discharge opening 13 referred to above. At a base portion of said rocking arm 17, there is mounted a gear 18, which is engaged with a sector gear 19. The sector gear 19 is arranged to be pivotally moved by a known power transmission mechanism including a cam (not shown) rotated by a motor (not shown) which functions as a power source for the entire apparatus 11, and a follower (not shown) to be actuated by said cam, etc. By the pivotal movement of the above sector gear 19, the rocking arm 17 is adapted to be pivoted in a vertical direction, i.e. between upper and lower positions. At a free end side of the rocking arm 17, there is mounted a semi-finished spring holding member 20, which has a pair of left and right semi-finished spring holding pieces 21. These holding pieces 21 are each pivotally mounted on the rocking arm 17 through corresponding pins 22, and are integrally formed with sector gear portions 23 which are in mesh with each other, so that when either one of the holding pieces 21 is a actuated, the other holding piece 21 is actuated in synchronization therewith. From the forward end of each of the holding pieces 21, a split semi-cylindrical holder 24 extends for holding the semi-finished spring 1 thereby, with spiral grooves 25 being formed in the inner peripheral surfaces of the holders 24 for facilitation in holding the semi-finished spring 1. Between the holding piece 21 at the left side and the rocking arm 17, a spring member 26 is disposed so that the holding member 20 is normally closed by the action of said spring member 26. Meanwhile, on the holding pieces 21 at the right side, there is provided a bracket 27, on which a roller 28 is rotatably mounted. Moreover, at the right side of the roller 28, a pressure plate 29 in an arcuate shape is disposed for opening the holding member 20 against the urging force of the spring member 26. The pressure plate 29 is formed into the arcuate shape as described above so that the pressure plate 29 can depress the roller 28, even when said rocking arm 17 is located in any positions within the movable range thereof. The pressure plate 29 is mounted on a sliding plate 31 through two connecting rods 30, while said sliding plate 31 is attached on a sliding sleeve 32, and said sliding sleeve 32 is slidably fitted in a fixed shaft 33, without any relative rotation with respect to said fixed shaft 33, which is mounted on the table 12 through a pair of brackets 34. The sliding plate 31 as described above is arranged to be moved in the lateral or leftward and rightward directions at desired time by a known power transmission mechanism 38 including a cam 35, a pivotal piece 36 and a connecting rod 37, etc. It is to be noted that the connecting rod 37 and the sliding plate 31 are connected to each other through a ball joint 39 as illustrated.

At the front portion of the spring discharge opening 13, there are provided a pair of bearings 41, in which a rotary shaft 43 having a rack portion 42 is rotatably fitted for simultaneous lateral movement therein. A pivotal member 44 is fitted onto the rotary shaft 43 without any rotative rotation with respect to said rotary shaft 43, while, on the under face of said pivotal member 44, there are mounted three gears 45, 46 and 47. The gear 45 engages the rack portion 42, and the rotation of said gear 45 is transmitted to the gear 47 through the gear 46. The gear 47 is mounted with a disc-rotary position control member 48, which is provided with a depending projection 49 for contacting the hook 4 of the semi-finished spring 1 located below the pivotal member 44 when said pivotal member 44 is brought into a horizontal state. The depending projection 49 as described above is arranged to catch the hook 4 of the semi-finished spring 1 held by the semi-finished spring holding member 20 through rotation of the rotational position control member 48 by the predetermined amount for causing the semi-finished spring 1 to rotate so as to move the hook 4 to a desired position.

The pivotal member 44 is adapted to be rocked at the desired time by a known power transmission mechanism 53 including a cam 50, a pivotal piece 51 and a connecting rod 52, etc., in which case, the rotary shaft 43 is rotated as one unit with the pivotal member 44.

Meanwhile, the rotary shaft 43 having the rack 42 is arranged to be laterally moved by a known power transmission mechanism 58 including a cam 54, a pivotal piece 55 and a ball joint 57, etc., and by the lateral movement of said rotary shaft 43 as described above, the gear 45 and in other words, the rotary position control member 48 is rotated.

It should be noted that the above arrangement may be modified in such a manner that the rotational position control member 48 is mounted on a horizontal rocking member or a horizontal moving bar provided on the table.

Figure 5:
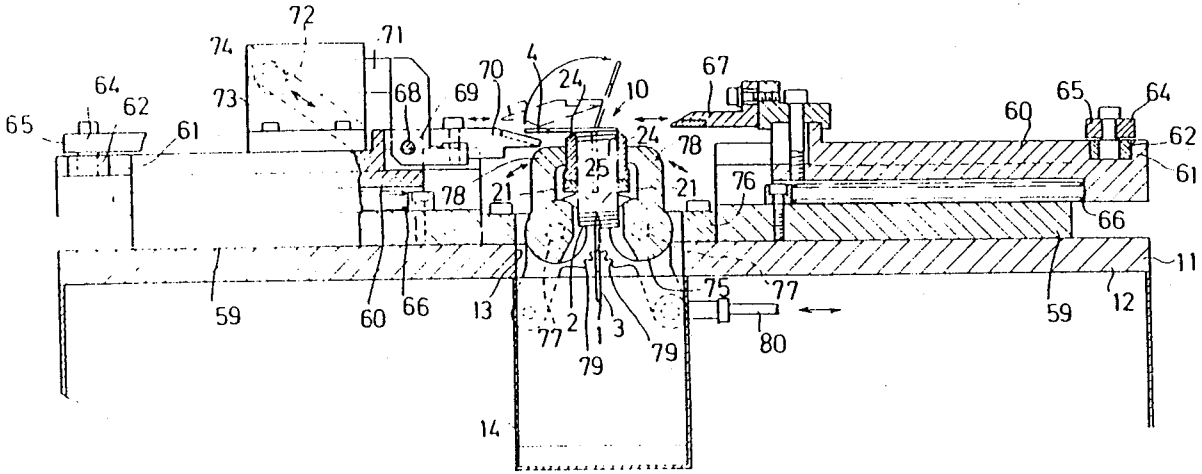
FIG. 5 is also a fragmentary cross sectional view taken the line V—V in FIG. 2.

As is clearly shown in FIGS. 2 and 5, on the table 12 in positions at the left and right sides of the discharge opening 13, there are fixedly mounted a pair of guide members 59, and by the respective guide members 59, slide members 60 are guided for free lateral movement. In the outer upper surface of each of the slide members 60, a groove 61 is formed. In each of the grooves 61, there is fitted a sliding piece 62, which is adapted to slide by a known power transmission mechanism 65 including a cam 63, a pivotal piece 64, etc. at any desired time, so that each of the slide members 60 is laterally moved through the corresponding slide piece 62. The slide members 60 are each urged in a direction away from the hook raising section 10 by spring members 66. At the left side end of the right side slide member 60, i.e. on the end portion at the side of the hook raising section 10, a hook raising tool 67 is attached. Meanwhile, at the right side end of the left side slide member 60, i.e. on the end portion at the side of the hook raising section 10, a tool support 69 is pivotally mounted for upward and downward movements, and on this tool support 69, a hook raising tool 70 is attached, so that the hook 4 is adapted to be raised through cooperation of this hook raising tool 70 and the hook raising tool 67 as described earlier. It should be noted here that configurations of the hooks to be raised may be altered by adjusting functionings of the tools 70 and 67 or abutting positions therebetween through the hook 4. An arm 71 is integrally formed with the tool support 69, and a roller 72 mounted at the free end of said arm 71 is fitted in an inclined groove 74 formed in a vertical wall 73 secured to a guide member 59, and by the movement of the roller 72 within the inclined groove 74, following the displacement of the slide member 60 at the left side, the tool support 69 (hook raising tool 70) is pivoted upwardly or downwardly. More specifically, as the left side slide member 60 advances towards the hook raising section 10, the forward end of the hook raising tool 70 is adapted to be raised.

As best shown in FIG. 5, a clamping unit 75 for fixing the pair of holders 24 located at the hook raising section 10, is provided on a frame member 76 surrounding the discharge opening 13. The clamping unit 75 as described above is provided with a pair of clamping pieces 78 pivotally mounted, through shafts 77, at the front and rear portions of said frame member 76, and the respective clamping pieces 78 are integrally formed with sector gears 79 which are in mesh with each other, so that said clamping pieces 78 are actuated in synchronization with each other. To either one of these clamping pieces 78, a connecting rod 80 is connected, and by operating said connecting rod 80 by a cam (not shown), the clamping pieces 78 may be opened or closed at desired periods.

It should be noted here that although not particularly shown in the foregoing embodiment, the pivotal pieces 36, 51, 55 and 64 are urged by spring members in such directions that the cam followers for the pivotal pieces 36, 51, 55 and 64 of the power transmission mechanisms 38, 53, 58 and 65 contact the cams 35, 50, 54 and 63, and that the power transmission mechanisms 38, 53, 58 and 65, etc. may be replaced by hydraulic cylinders and the like arranged to actuate predetermined members.

Subsequently, operations for use of the hook raising apparatus 11 as described so far will be explained hereinbelow.

In the first place, in order to sequentially effect the desired functions as described below, the configurations of the cams 35, 50, 54 and 63 and other cams (not particularly shown) are adjusted, with simultaneous adjustments of mounting positions thereof with respect to the corresponding cam shafts. It is to be noted that the respective cams are adapted to rotate in synchronization with each other by one electric motor (not particularly shown).

Thereafter, the position of the table 12 in the vertical direction and in the lateral direction of the table 12 is adjusted so that the semi-finished spring 1 cut out from the spring manufacturing machine 9 can be held between the pair of semi-finished spring holding pieces 21 (holders 24) of the rocking arm 17 in the upright or erected state.

After the preparation as described above, when the spring manufacturing machine 9 and the hook raising apparatus 11 are operated in synchronization with each other, functionings as follows are effected. More specifically, before the semi-finished spring 1 manufactured by the spring manufacturing machine 9 is cut out therefrom, the rocking arm in the course of erection is caused to stand perfectly upright so as to apply the holders 24 with the pair of holding pieces opened, onto the semi-finished spring 1. Subsequently, when the holders 24 are closed to hold the semi-finished spring 1 therebetween, the spring manufacturing machine 9 cuts off the semi-finished spring 1, and thus, the rocking arm 17 is pivoted into the horizontal state so as to transfer the semi-finished spring 1 to the hook raising section 10. It is to be noted here that in the above case, the pair of clamping pieces 78 of the clamping unit 75 are opened, with the pivotal member 44 being also in the opened state. Thereafter, the pivotal member 44 is moved above the holder 24 in pair, with the subsequent rotation of the rotational position control member 48, and thus, the hook 4 is caught by the depending projection 49 so as to position the hook 4 at the upper portion of the hook raising tool 70 at the left side. It is needless to say that the rotational direction of the rotational position control member 48 may be freely adjusted as desired by adjusting the configuration of the cam 54, according to the direction of the hook 4 of the semi-finished spring 1 held by the holder 24 in pair. In the next step, the pivotal member 44 is opened (i.e. pivoted upwardly), while the rotational position control member 48 is rotated in the reverse direction back to the original position in preparation for the subsequent functioning. Simultaneously with the above function, the pair of clamping pieces 78 of the clamping unit 75 are closed so as to rigidly hold the holder 24 in pair therebetween. Then, the slide members 60 at the left and right sides project towards the hook raising section 10 for raising the hook 4 up to a position at which the spring back of the hook 4 thus raised is taken into account. After raising the hook 4, the slide members 60 at the left and right sides are caused to retreat, and then, the pair of clamping pieces 78 and the holder 24 in pair are opened, and therefore, the finished spring is led onto the chute 14 through the discharge opening 13 so as to be dropped into a box or container (not shown) provided at the outside of the apparatus 11 by rolling over the chute 14. The rocking arm 17 from which the finished spring is thus discharged, is again caused to be erected.

As is clear from the foregoing description, according to the hook raising apparatus of the present invention, the hook raising operation for semi-finished spring products may be effected in an extremely efficient manner, since the finished springs processed for the hook raising can be automatically discharged by the lateral holding of the semi-finished springs instead of the vertical holding thereof in the conventional arrangements, while the hook raising may be carried out after subjecting the semi-finished springs to proper positional control.

While a specific embodiment of the present invention has been shown and described in detail to illustrate the applications of the invention, it should be noted that the present invention may be embodied otherwise in various ways without departing from the scope thereof.

What is claimed is:

1. An apparatus for raising hooks of semi-finished spring products, which comprises a rocking arm arranged to be pivotally movable between an upper and a lower position, a pair of laterally extending semi-finished spring holding pieces at a forward end portion of said rocking arm for transferring the semi-finished springs manufactured by a spring manufacturing machine towards a hook raising section provided above a spring discharge opening formed in a table of said apparatus, a clamping unit for fixedly clamping the semi-finished spring holding pieces which have been transferred to said hook raising section, a rotational position control member which rotates the semi-finished spring held between said semi-finished spring holding pieces for positional control thereof, and a pair of slide members on which hook raising tools are mounted and which are adapted to freely advance towards or retreated from the hook raising section as desired.

2. An apparatus as claimed in claim 1, wherein said slide member is provided with a tool support pivotally mounted thereon for pivotal movement between an upper and a lower position, said tool support being arranged to be raised in its forward end as said slide member is caused to advance.

3. An apparatus as claimed in claim 1, wherein said rotational position control member is provided with a depending projection, and is rotatably mounted on a pivotal member arranged to be pivotable with respect to said table of said apparatus.

4. An apparatus as claimed in claim 1, wherein the pair of said semi-finished spring holding pieces are each integrally formed with sector gears which are in mesh with each other, whereby, upon functioning of either one of said holding pieces, the other holding piece is actuated in synchronization therewith.

5. An apparatus as claimed in claim 4, wherein each of said holding pieces is mounted, at its forward end portion, with a semi-cylindrical holder, with a spiral groove being formed in the inner peripheral surface of said semi-cylindrical holder for facilitation in holding the semi-finished spring.

6. An apparatus as claimed in claim 1, wherein said clamping unit includes a pair of clamping pieces, said clamping pieces being respectively integrally formed with sector gears which are in mesh with each other so that said clamping pieces are operated in synchronization with each other.

* * * * *